US006866016B2

(12) United States Patent
Cueman

(10) Patent No.: US 6,866,016 B2
(45) Date of Patent: Mar. 15, 2005

(54) SYSTEM AND METHOD FOR CONTROLLING IGNITION IN INTERNAL COMBUSTION ENGINES

(75) Inventor: Michael Kent Cueman, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 21 days.

(21) Appl. No.: 10/619,875

(22) Filed: Jul. 14, 2003

(65) Prior Publication Data

US 2005/0011486 A1 Jan. 20, 2005

(51) Int. Cl.[7] ..... F02B 3/00
(52) U.S. Cl. ..... 123/299; 123/300
(58) Field of Search ..... 123/294, 299, 123/300, 304, 305, 445

(56) References Cited

U.S. PATENT DOCUMENTS 5,365,902 A 11/1994 Hsu
6,283,100 B1 9/2001 Chen et al.
6,595,182 B2 * 7/2003 Oprea et al. ..... 123/297
6,705,277 B1 * 3/2004 McGee ..... 123/299

FOREIGN PATENT DOCUMENTS

EP 0364209 B1 * 10/1989
EP 0364209 2/1994

OTHER PUBLICATIONS

Article Methanol (MeOH)/ Dimethyl (DME) as an Alternative Fuel Jul. 8, 2003.*

* cited by examiner

*Primary Examiner*—Bibhu Mohanty
(74) *Attorney, Agent, or Firm*—Ann M. Agosti; Patrick K. Patnode

(57) ABSTRACT

Ignition of a main fuel in an internal combustion engine having at least one cylinder having a combustion chamber is accomplished by diverting a portion of the main fuel to a processing system; processing said portion of the main fuel to increase ignition sensitivity thereof and form a pilot fuel; introducing the main fuel into the combustion chamber; and introducing said pilot fuel to control ignition of the main fuel.

39 Claims, 2 Drawing Sheets

SYSTEM AND METHOD FOR CONTROLLING IGNITION IN INTERNAL COMBUSTION ENGINES

BACKGROUND OF THE INVENTION

The invention relates generally to a system and method for controlling ignition in a homogeneous charge compression ignition (HCCI) engine by injecting a pilot fuel in conjunction with a main fuel. The system and method of this invention may be used to advantage in diesel fuel engines, and especially locomotive engines, as well as any other reciprocating engine.

Diesel engines efficiently convert the latent heat of hydrocarbon fuel into useful mechanical power. In the operation of conventional diesel engines, a metered amount of fuel is injected into each cylinder of the engine at recurrent intervals synchronized with rotation of the engine crankshaft to coincide with the air-compression stroke of a reciprocating piston. The compression of the air charge greatly increases its temperature. The fuel is sprayed into the cylinder near the top of the piston stroke where it quickly ignites in the high temperature air. The resulting combustion or firing of fuel in the cylinder forces the piston to move in the opposite direction, thereby applying torque to the engine camshaft.

Conventional diesel engine fuel is a relatively low grade, refined petroleum known generally as diesel fuel oil that has desirable ignition and heat release characteristics. Diesel fuel oil has acceptably low levels of corrosive, abrasive and other noxious matter, and it is in ample supply at the present time.

Diesel engines typically burn fuel in a diffusion combustion mode. In that mode, the fuel burns as it comes into the chamber before it is well mixed with air. Since only pure air is compressed in the compression stroke of the engine, a high compression ratio can be used to obtain high cycle efficiency. However, the local combustion air to fuel ratio cannot be controlled. Much of the burning takes place in the fuel rich zones surrounding the droplets of injected fuel. This results in local hot spots and relatively high production of nitrogen oxides and other regulated pollutants.

On the other hand, Otto Cycle gasoline engines, such as automobile engines, burn fuel after it has been well mixed with air. This mode of burning fuel is called premixed combustion. In this mode, the fuel is pre-mixed with air to form a combustible mixture. The mixture is compressed in the compression stroke of the engine. The compression ratio is limited to a lower value to avoid premature ignition that results in hazardous "detonation" or "knock". This lower compression ratio results in lower cycle efficiency. However, the premixing provides better control of the local combustion air to fuel ratio. This reduces local hot spots and lowers the production of nitrogen oxides and other regulated pollutants. The conventional gas engine operates in this combustion mode. Ignition of the fuel mixture is timed by a spark. Usually, the gas fuel is introduced at low pressure either into the intake manifold or directly into the engine cylinder before the compression stroke.

There are other combustion options that blend the advantages of conventional Diesel and Otto cycle engines. For instance, some dual fuel gas engines, called high pressure injection gas engines, have become known in the art. They also utilize a diffusion combustion mode, with an ignition source that is used to ignite the fuel.

More than 65 years ago it was recognized that a small amount of readily ignitable pilot fuel could be injected in diesel engines to improve combustion of "heavy" hydrocarbon fuels that are otherwise difficult to ignite. See British Patent No. 124,642. As used herein, the term "pilot fuel" means relatively light hydrocarbon fuel (e.g. methanol or even standard diesel fuel oil) characterized by being significantly easier to ignite than the primary fuel in the injection system.

Homogeneous charge compression ignition (HCCI) engines are a hybrid of gasoline and diesel engines in which HCCI engines offer high efficiency and very low emissions compared to diesel engines. However, HCCI engines rely on autoignition of their air-fuel (A/F) mixture and are difficult to control ignition thereof during compression. Ignition timing in HCCI engines is currently regulated by modulating the temperature or richness of the fuel mixture in the engine cylinder. Exhaust gas recirculation and modulation of the input charge aftercoolers are typical means of achieving this end.

BRIEF DESCRIPTION OF THE INVENTION

It would be desirable to stabilize ignition timing of an HCCI engine by increasing the control options available to control ignition timing thereof.

The above discussed and other drawbacks and deficiencies of the prior art are overcome or alleviated by a system and method to control ignition of a low cetane fuel in an internal combustion engine, particularly a HCCI engine.

In accordance with one embodiment of the present invention, a method of controlling ignition of a main fuel in an internal combustion engine having at least one cylinder having a combustion chamber comprises: diverting a portion of the main fuel to a processing system; processing said portion of the main fuel to increase ignition sensitivity thereof forming a pilot fuel; introducing the main fuel into the combustion chamber; and introducing said pilot fuel to control ignition of the main fuel.

In accordance with another embodiment of the present invention, a system for controlling ignition of a main fuel in an internal combustion engine having at least one cylinder having a combustion chamber comprises: a processing system in fluid communication with the main fuel for receiving a portion of the main fuel and processing said portion of the main fuel to increase ignition sensitivity thereof forming a pilot fuel; a means to introduce the main fuel into the combustion chamber; and a means to introduce said pilot fuel to control ignition of the main fuel.

In accordance with another embodiment of the present invention, a diesel locomotive internal combustion engine comprising at least two cylinders, each having a reciprocating piston operatively connected to a crank and a combustion chamber, also comprising means for separately injecting a primary main fuel and a high combustion auxiliary pilot fuel into the combustion chambers of an internal combustion diesel engine comprises: a processing system in fluid communication with the main fuel, a portion of the main fuel flowing to the engine is diverted to said processing system, said processing system configured to process said portion of the main fuel to increase ignition sensitivity thereof forming the pilot fuel; a means to introduce the main fuel into the combustion chamber; and a means to introduce the pilot fuel to control ignition of the main fuel.

BRIEF DESCRIPTION OF THE DRAWINGS

Referring to the exemplary drawings wherein like elements are numbered alike in the several Figures.

DETAILED DESCRIPTION OF THE INVENTION

Disclosed herein is an additional control technique to modulate ignition timing within an engine, particularly HCCI engines, by introducing a main fuel which is hard to ignite in an A/F mixture during an intake stroke and introducing a pilot fuel more flammable than the main fuel at a desired point in the engine cycle. In this manner, the introduction of pilot fuel during compression of the main fuel into the chamber immediately ignites the small portion of pilot fuel upon entry into the combustion chamber as a result of the heat created by compression of the main fuel A/F mixture. The ignition of the pilot fuel causes ignition of the harder to ignite main fuel. The main fuel and pilot fuel are both obtained from a single fuel supply where the pilot fuel is an in situ reformed main fuel forming a lighter hydrocarbon based pilot fuel which is easier to ignite compared to the heavier hydrocarbon based main fuel.

Figure 1:
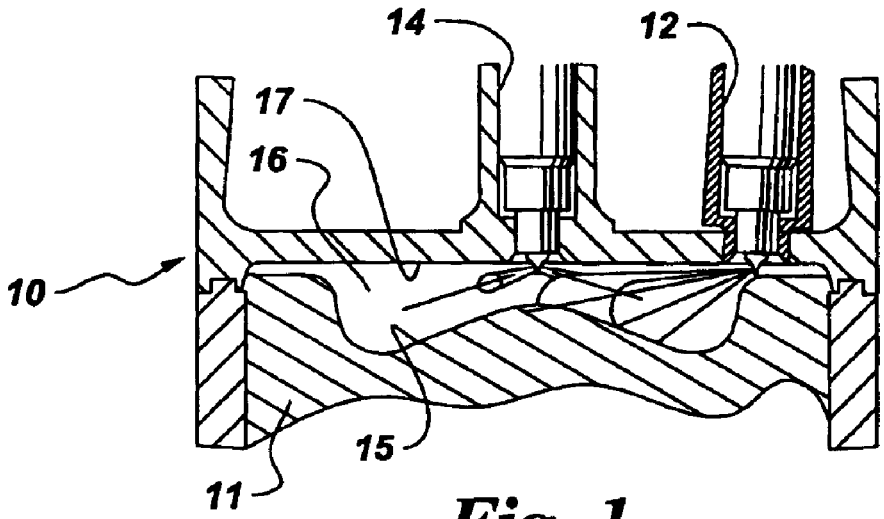
FIG. 1 is a sketch showing one embodiment of a pilot fuel and main fuel combustion chamber which may be used in the present invention.

FIG. 1 depicts the components of a typical combustion chamber of a cylinder in an HCCI engine that are relevant to this invention. It will be noted that illustration of air intake and exhaust valves have been omitted for the sake of clarity and simplicity. Cylinder 10 of the HCCI engine houses a reciprocating piston 11 which is operatively connected to a crankshaft 8 (represented in FIG. 4) as is known to those skilled in the art. The combustion chamber 16 of the cylinder 10 consists of the area in the cylinder between the top 15 of the piston 11 and below the cylinder head 17.

Cylinder 10 is provided with means for introducing two fuels into the combustion chamber 16. Means for introducing the main fuel comprises main fuel injector 12. In the two fuel injection system shown, the main fuel is introduced early in engine cycle and is compressed along with the input air charge and the pilot fuel is a readily combustible fuel, such as pilot diesel fuel reformed from the main fuel to form a lighter hydrocarbon based fuel. In the embodiment illustrated, a separate fuel injector 14 is used to inject the pilot fuel. Alternatively, one injector having two fuel systems may be used.

Conventional diesel engines and HCCI engines typically have a crankshaft mechanically coupled to a variable load such as the rotor of an alternating current generator that supplies electric power to an electric load circuit. The power output of the generator and hence the load imposed on the engine crankshaft is limited by a regulator. The engine typically has multiple sets of two cylinders in which reciprocating pistons are respectively disposed, the pistons being respectively connected via rods and journals to individual eccentrics or cranks of the crankshaft. In a typical medium speed 4,000 to 6,000-horsepower engine, there are 12 to 16 cylinders, the cylinder bore is approximately nine inches, and the compression ratio is of the order of 12 to 20. Each cylinder has air inlet and exhaust valves (See FIG. 3) that are controlled by associated cams on the engine camshaft which is mechanically driven by the crankshaft In a 4-stroke engine, the camshaft turns once per two full revolutions of the crankshaft, and therefore 2:1 speed reducing gearing is provided.

In one embodiment of this invention, a multi-cylinder HCCI engine includes cylinders where each combustion chamber 16 has a central mounted pilot diesel fuel injector 14 and a side placed main fuel injector 12. The pilot fuel injection system and the main fuel injection systems can be built using conventional injection system fabrication technology. The injection timings and quantities depend on whether the fuels are premixed together before combustion or are mixed together at a point in which ignition is desired and can be used to precisely control a point of ignition in the engine. Example embodiments for timing and amount variations are described below.

High pressure (e.g., 3500–4000 psi) compressed diesel fuel is injected through the fuel (or main fuel) injector 12 providing the bulk of the fuel needed for full load operation. A small amount of pilot fuel, such as about 2% to about 15%, and more preferably between about 4% to about 7% by energy is injected through the pilot injector 14 to provide an ignition source for the gas fuel. Other readily combustible pilot fuels may also be used, as long as they are derived from the heavier hydrocarbon based main fuel. This is known as the basic "High Pressure Injection" design.

Normally, the high pressure injection design burns the fuel in the diffusion combustion mode. The pilot fuel combustion causes the gas fuel to burn as soon as it enters the combustion chamber 16. In this fashion, the fuel does not have time to be pre-mixed evenly with air before ignition. Since no combustible mixture of fuel is subjected to high in-cylinder compression temperature and pressure, the well known uncontrollable "combustion knock" of reciprocating internal combustion engine will not occur. A high compression ratio can thus be used to obtain high efficiency and high engine power output. No special inlet air cooling to prevent "knock" is necessary. Since this design burns gas fuel in the same diffusion mode as liquid diesel fuel in a normal diesel engine, the emissions level is not much different from a standard diesel engine.

Figure 2:
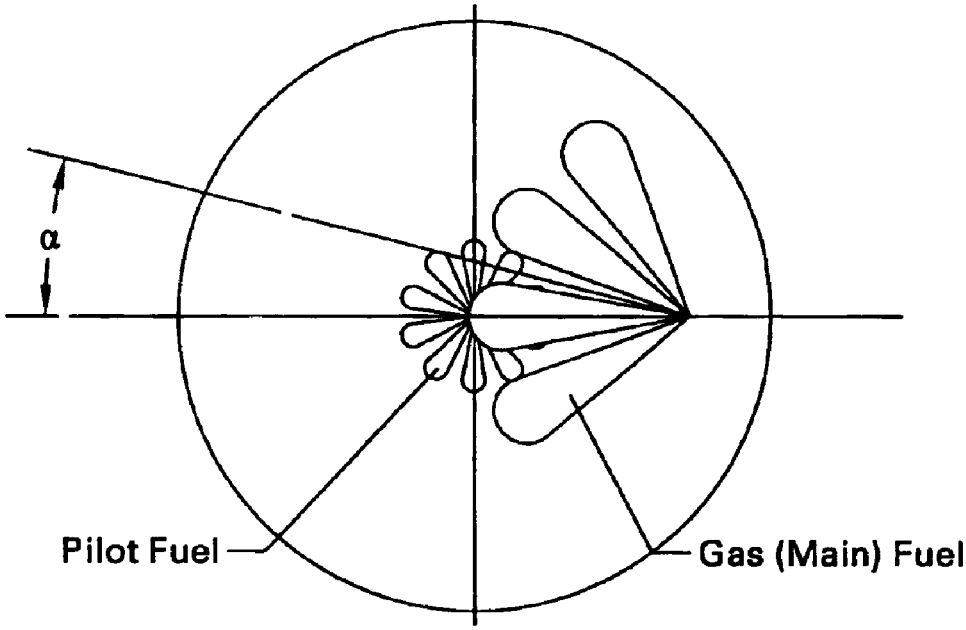
FIG. 2 is a sketch showing the angle at which the pilot fuel and main fuel are injected in the combustion chamber shown in FIG. 1.

In one embodiment of this invention, as is shown in FIG. 1, the pilot injector 14 is located in the center of the engine cylinder 10 with symmetrically distributed fuel sprays. The high pressure gas (main fuel) injector 12 is located on the side of the cylinder, with sprays generally aimed towards the center of the cylinder 10. However, the symmetry line of the spray is at an angle $\alpha$ to the cylinder diameter, as shown in FIG. 2. Angle $\alpha$ should be a sufficient number of degrees so that an angular momentum to the cylinder charge results when the gas injection starts, and so that a substantial (greater than or equal to about fifty percent) amount of the main fuel is intermixed with cylinder charged air prior to combustion. In the example shown, angle $\alpha$ is about 14 degrees, but it may vary depending on the dimensions of the cylinder, the arrangement of the pilot fuel injectors and gas fuel injectors with respect to one another, and on other factors. The introduction of the main fuel at an angle is useful to help the premixed fuel sufficiently utilize cylinder charged air. The gas that is injected before ignition will be pre-mixed with air before ignition. Since the overall equivalence ratio is correct, some pre-mixed lean burning of gas will occur. Consequently, some reduction of NOx and particulate emissions will be obtained. The earlier the main fuel is injected in advance of the pilot fuel, the more pre-mixed type of burning will occur. The limit of main injection advance and quantity in relation to pilot fuel is the point at which "knocking" would begin. Thus, low emission type of "lean burn" is used to the fullest extent while maintaining the high efficiency and output of a high pressure gas injection type engine. As stated before, the layout of the cylinder need not be exactly as shown. A concentric dual fuel injector that can provide well mixing of pre-mixed fuel will also serve the purpose. Alternatively, the premixed portion of the fuel can be supplied through the intake manifold or into the engine cylinder before the compression stroke, as depicted in FIG. 3.

Figure 3:
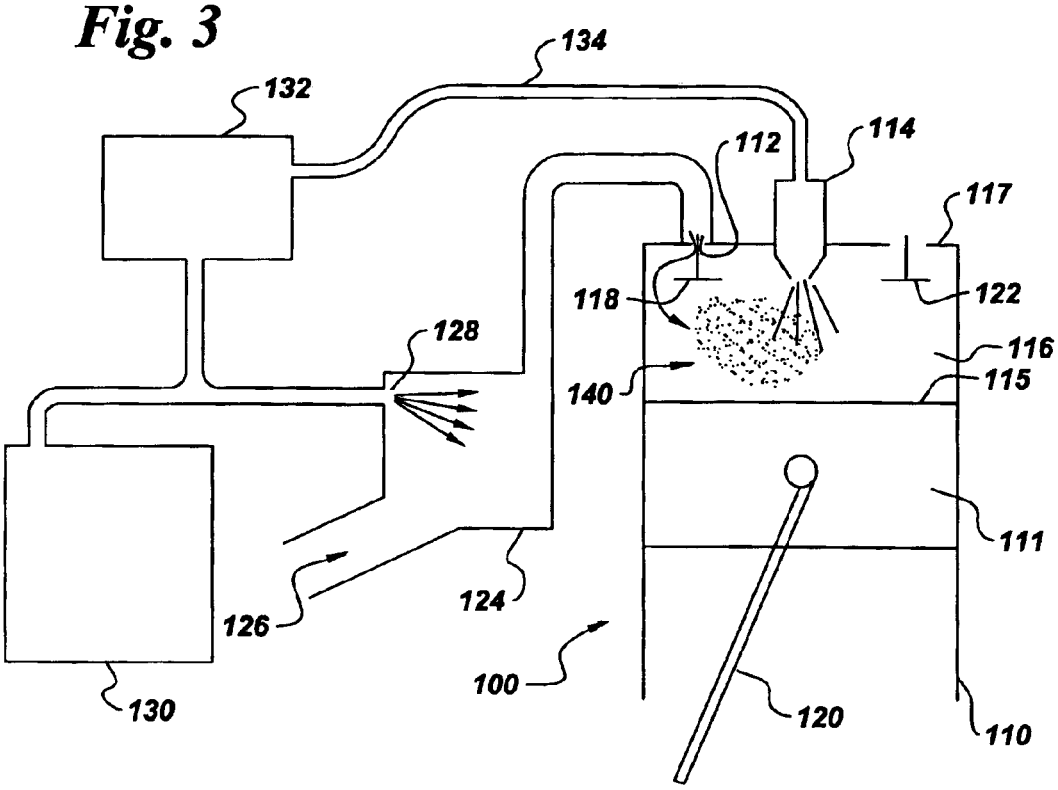
FIG. 3 is a sketch showing another embodiment of a pilot fuel and main fuel combustion chamber in operable communication with a single fuel supply.

Referring now to FIG. 3, an exemplary embodiment of an HCCI engine is schematically shown generally at 100. HCCI engine 100 includes at least one cylinder 110 housing a reciprocating piston 111 which is operatively connected to a crankshaft (not shown) as is known to those skilled in the art. A combustion chamber 116 of the cylinder 110 consists of the area in the cylinder between the top 115 of the piston 111 and below the cylinder head 117.

Cylinder 110 is provided with means for introducing two fuels into the combustion chamber 16. Means for introducing the main fuel comprises main fuel inlet port 112 that is operably closed and opened via an intake valve 118. In the two fuel injection system shown, the main fuel is compressed diesel fuel and the other fuel is a readily combustible fuel, such as a pilot diesel fuel reformed from the main fuel to form a lighter hydrocarbon based fuel. In the embodiment illustrated, a separate fuel injector 114 is used to inject the pilot fuel. Alternatively, one injector having two fuel systems may be used.

Conventional diesel engines and HCCI engines typically have multiple sets of two cylinders in which reciprocating pistons are respectively disposed, the pistons being respectively connected via rods 120 and journals to individual eccentrics or cranks of the crankshaft. Each cylinder has inlet and exhaust valves 118 and 122, respectively that are controlled by associated cams on the engine camshaft which is mechanically driven by the crankshaft. In a 4-stroke engine, the camshaft turns once per two full revolutions of the crankshaft, and therefore 2:1 speed reducing gearing is provided.

Inlet valve 118 is in fluid communication with an intake manifold 124 that is in fluid communication with outside air at a first inlet 126 and main fuel via a second inlet 128 to intake manifold 124. As air and fuel enter intake manifold 124 via inlets 126 and 128, respectively, an air/fuel (A/F) mixture results that is directed to inlet 112 of cylinder 110.

The main fuel originates from a single fuel supply 130 that further supplies a processing system 132. The processing system 132 processes main fuel into a lighter hydrocarbon based pilot fuel. The processed main fuel or pilot fuel is then directed to pilot fuel injector 114 via tubing 134 for injection into chamber 116 at a predetermined time.

In an exemplary embodiment depicted in FIG. 3, a small portion of the diesel fuel or main fuel flowing to engine 100 via intake manifold 124 is diverted into secondary system or processing system 132. The processing system 132 processes the main fuel to increase its ignition sensitivity. The small flow of processed, more sensitive fuel is then separately routed via tubing 1134 to the main engine 100 at the appropriate time to control the ignition of the main A/F charge shown generally at 140.

Processing systems 132 is an external processor which increases the ignitability of the main fuel, including diesel fuel for example. The processing system 132 is configured to process a heavier hydrocarbon based fuel and generate a lighter hydrocarbon based fuel that is more easily ignited. In one embodiment, for example, the main fuel has a cetane number between about 5 to about 35 while the pilot fuel generated has a cetane number between about 40 to about 60, where a lower cetane number is indicative of a hard to ignite fuel and a higher cetane number is indicative of an easier ignite fuel.

Processing system may include an in situ "reformer" (similar to those used to process hydrocarbon fuel for hydrogen fuel cell operation), a catalytic device, or a partial oxidation combustor (like those used to process fuel for pulse detonation aircraft engine research). In any of these in situ systems, the corresponding processor or device breaks the heavy hydrocarbons in the main fuel, e.g., diesel fuel, into smaller molecules, notably hydrogen and carbon monoxide. The resulting compounds are very easy to ignite. The processed fuel, which now may be either liquid or largely gaseous, is reintroduced into the main engine 100 via injector 114 at a predetermined time to control ignition/combustion timing.

Control of ignition/combustion timing may be achieved by either mixing a portion of this processed fuel or pilot fuel into the main charge having the main fuel to regulate its chemistry and, hence, its ignition properties. Alternatively, ignition/combustion timing control is achieved by separately injecting a portion of this fuel into the main engine cylinders 110 when the main mixture is highly compressed (and therefore hot). In other words, the main fuel is introduced into the combustion chamber 116 prior to the pilot fuel being injected. When the sensitive fuel or pilot fuel is injected into the hot main cylinder 110, it will immediately ignite and create a pilot flame to touch off the main charge. Both approaches have the effect of controlling the timing of the ignition of the main charge, e.g., main diesel charge.

Figure 4:
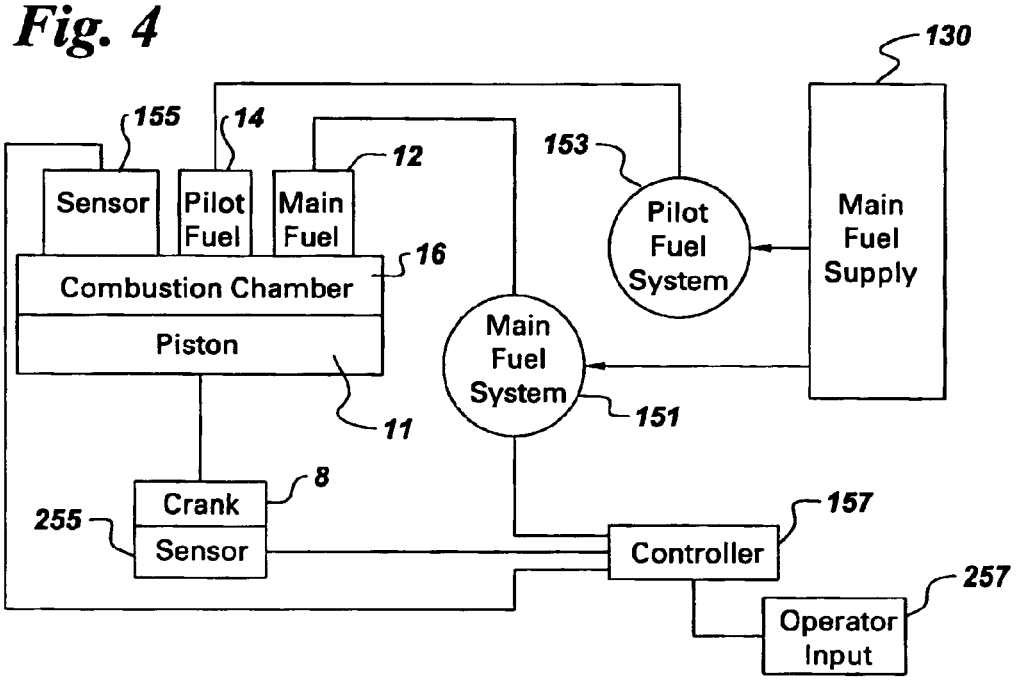
FIG. 4 is a block diagram schematically illustrating a controller used in the invention as depicted in FIGS. 1 and 3.

An apparatus for practicing this invention is shown in block diagram form in FIG. 4. Each of the fuel injectors 12 and 14 (as shown in FIG. 1) or alternatively, a single injection system, are operatively connected to fuel injection systems 151 and 153. The fuel injection system for the main fuel may be any system which is known to those skilled in the art. The fuel injection system for the pilot fuel 153 may be any system which is known to those skilled in the art. The main charge is injected early in the intake stroke by fuel injection system 151. Pilot fuel (e.g., a small amount) is injected near top dead center (TDC) after compression to trigger combustion by fuel injection system 153. Sensor means 155 and 255, which may be pressure transducers, temperature sensors, and/or engine crank encoders are provided in communication with the combustion chambers, and/or the crank, and/or the linkage of the engine, and/or an operator input 257. Control means 157, which may be a computer or any microprocessor driven device, are in communication with such sensor or sensors. The control means are operatively in communication with the fuel injection systems, and control those systems in response to the operator input, as well as controlling fuel injection system 153 to properly trigger combustion and avoid knocking. Operator input 257 comprises a device analogous to the throttle for Otto cycle engines or a controller for changing the stroke of an injector pump in a diesel engine, for example.

The above described invention includes the principal of injecting a more flammable mixture to initiate combustion. In one embodiment, a portion of the easily ignited sensitive fuel is mixed into the main supply to control HCCI combustion. Alternatively, a small portion of the easily ignited sensitive fuel is separately injected into the compressed charge of normal fuel at the moment of desired ignition. Both approaches have the effect of controlling the timing of the ignition of the main diesel charge. In either manner, only a single fuel, e.g., normal diesel, is required. The onboard processing of the "sensitized" fuel greatly reduces the infrastructure required to support this technology. In situ production of the more easily ignited fuel from normal diesel includes reforming, catalytic processing, or partial oxidation (rich) combustion. In one elementary embodiment, this may include passing the main fuel over a heated catalytic converter to obtain the sensitized pilot fuel.

The above described embodiments can be used to combine the advantages of clean premixed combustion with efficient and controllable diffusion combustion in an engine with both diesel and HCCI characteristics. The above described embodiments provide use of a more easily ignited fuel to control HCCI combustion by mixing a portion of this sensitive fuel into the main supply or use of a more easily ignited fuel to control. HCCI combustion by separately injecting the sensitive fuel into the compressed charge of normal fuel at the moment of desired ignition.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of controlling ignition of a main fuel in an internal combustion engine having at least one cylinder having a combustion chamber, the method comprising:

diverting a portion of the main fuel to a processing system;

processing said portion of the main fuel to increase ignition sensitivity thereof and form a pilot fuel;

introducing the main fuel into the combustion chamber; and introducing said pilot fuel to control ignition of the main fuel.

2. The method of claim 1 wherein the main fuel is injected with a symmetry line of spray at an angle with respect to a diameter of the combustion chamber, the angle being sufficiently large so that a substantial amount of the main fuel is intermixed with cylinder charged air prior to combustion.

3. The method of claim 1 wherein the main fuel is diesel fuel.

4. The method of claim 1 wherein said processing includes processing heavier hydrocarbons of said portion of the main fuel to generate said pilot fuel having lighter hydrocarbons.

5. The method of claim 1 wherein the engine is a homogeneous charge combustion injection (HCCI) engine.

6. The method of claim 1 wherein the main fuel is introduced prior to introducing said pilot fuel.

7. The method of claim 6 wherein when said pilot fuel is introduced, said main fuel is part of a compressed main charge and said pilot fuel is immediately ignited upon entry into the combustion chamber heated by compression creating a pilot flame to ignite said main charge.

8. The method of claim 1 wherein said pilot fuel is mixed with the main fuel forming a mixed main charge at a selected time prior to combustion in a manner to regulate said main charge chemistry to control ignition properties thereof.

9. The method of claim 1 wherein the main fuel has a cetane number between about 5 to about 35, while said pilot fuel has a cetane number between about 40 to about 60.

10. The method of claim 1 wherein said pilot fuel is less than about 7% while the main fuel is greater than about 93% of the total volume of fuel ignited in the combustion chamber.

11. The method of claim 1 wherein said processing said portion of the main fuel to increase ignition sensitivity thereof forming a pilot fuel includes one of reforming; catalytic processing; or partial oxidation combustion.

12. A method of controlling ignition of a main fuel in an internal combustion engine having at least one cylinder having a combustion chamber, the method comprising:

diverting a portion of the main fuel to a processing system, wherein the main fuel comprises a diesel fuel;

processing said portion of the main fuel to increase ignition sensitivity thereof and form a pilot fuel;

injecting the main fuel into the combustion chamber with a symmetry line of spray at an angle with respect to a diameter of the combustion chamber, the angle being sufficiently large so that a substantial amount of the main fuel is intermixed with cylinder charged air prior to combustion; and introducing said pilot fuel to control ignition of the main fuel.

13. The method of claim 12 wherein the engine is a homogeneous charge combustion injection (HCCI) engine and wherein said processing includes processing heavier hydrocarbons of said portion of the main fuel to generate said pilot fuel having lighter hydrocarbons.

14. The method of claim 13 wherein the main fuel is introduced prior to introducing said pilot fuel.

15. The method of claim 14 wherein when said pilot fuel is introduced, said main fuel is part of a compressed main charge and said pilot fuel is immediately ignited upon entry into the combustion chamber heated by compression creating a pilot flame to ignite said main charge.

16. The method of claim 13 wherein said pilot fuel is mixed with the main fuel forming a mixed main charge at a selected time prior to combustion in a manner to regulate said main charge chemistry to control ignition properties thereof.

17. The method of claim 13 wherein the main fuel has a cetane number between about 5 to about 35, while said pilot fuel has a cetane number between about 40 to about 60.

18. The method of claim 13 wherein said pilot fuel is less than about 7% while the main fuel is greater than about 93% of the total volume of fuel ignited in the combustion chamber.

19. The method of claim 13 wherein said processing said portion of the main fuel to increase ignition sensitivity thereof forming a pilot fuel includes one of reforming; catalytic processing; or partial oxidation combustion.

20. A control system for controlling ignition of a main fuel in an internal combustion engine having at least one cylinder having a combustion chamber comprising:

a processing system in fluid communication with the main fuel configured for receiving a portion of the main fuel and processing said portion of the main fuel to increase ignition sensitivity thereof and form a pilot fuel;

a main fuel system configured to introduce the main fuel into the combustion chamber; and a pilot fuel system configured to introduce said pilot fuel to control ignition of the main fuel.

21. The control system of claim 20 wherein the main fuel system is configured to inject the main fuel in a manner so that a substantial amount of the main fuel is intermixed with cylinder charged air prior to combustion.

22. The control system of claim 20 wherein the main fuel is diesel fuel.

23. The control system of claim 20 wherein said processing system includes an in situ processing system configured to process heavier hydrocarbons of said portion of the main fuel and generate said pilot fuel having lighter hydrocarbons.

24. The control system of claim 20 wherein the engine is a homogeneous charge combustion injection (HCCI) engine.

25. The control system of claim 20 further comprising a fuel system controller configured for controlling the main and pilot fuel systems so that the main fuel is introduced prior to introducing said pilot fuel.

26. The control system of claim 25 further comprising a fuel system controller configured for controlling the main and pilot fuel systems so that when said pilot fuel is introduced, said main fuel is part of a compressed main charge and said pilot fuel is immediately ignited upon entry into the combustion chamber heated by compression creating a pilot flame to ignite said main charge.

27. The control system of claim 20 further comprising a fuel system controller configured for controlling the main and pilot fuel systems so that said pilot fuel is mixed with the main fuel forming a mixed main charge at a selected time prior to combustion in a manner to regulate said main charge chemistry to control ignition properties thereof.

28. The control system of claim 20 wherein the main fuel has a cetane number between about 5 to about 35, while said pilot fuel has a cetane number between about 40 to about 60.

29. The control system of claim 20 wherein said pilot fuel is less than about 7% while the main fuel is greater than about 93% of the total volume of fuel ignited in the combustion chamber.

30. The control system of claim 20 wherein said processing system configured to process said portion of the main fuel to increase ignition sensitivity thereof forming a pilot fuel further includes one of: a reformer; a catalytic device; or a partial oxidation combustor.

31. A control system for controlling ignition of a main fuel comprising diesel fuel in an internal combustion engine having at least one cylinder having a combustion chamber comprising:

a processing system in fluid communication with the main fuel configured for receiving a portion of the main fuel and processing said portion of the main fuel to increase ignition sensitivity thereof and form a pilot fuel;

a main fuel system configured to inject the main fuel into the combustion chamber with a symmetry line of spray at an angle with respect to a diameter of the combustion chamber, the angle being sufficiently large so that a substantial amount of the main fuel is intermixed with cylinder charged air prior to combustion; and a pilot fuel system configured to introduce said pilot fuel to control ignition of the main fuel.

32. The control system of claim 31 wherein the engine is a homogeneous charge combustion injection (HCCI) engine and wherein said processing system includes an in situ processing system configured to process heavier hydrocarbons of said portion of the main fuel and generate said pilot fuel having lighter hydrocarbons.

33. The control system of claim 32 further comprising a fuel system controller configured for controlling the main and pilot fuel systems so that the main fuel is introduced prior to introducing said pilot fuel.

34. The control system of claim 33 further comprising a fuel system controller configured for controlling the main and pilot fuel systems so that when said pilot fuel is introduced, said main fuel is part of a compressed main charge and said pilot fuel is immediately ignited upon entry into the combustion chamber heated by compression creating a pilot flame to ignite said main charge.

35. The control system of claim 31 further comprising a fuel system controller configured for controlling the main and pilot fuel systems so that said pilot fuel is mixed with the main fuel forming a mixed main charge at a selected time prior to combustion in a manner to regulate said main charge chemistry to control ignition properties thereof.

36. The control system of claim 31 wherein the main fuel has a cetane number between about 5 to about 35, while said pilot fuel has a cetane number between about 40 to about 60.

37. The control system of claim 31 wherein said pilot fuel is less than about 7% while the main fuel is greater than about 93% of the total volume of fuel ignited in the combustion chamber.

38. The control system of claim 31 wherein said processing system configured to process said portion of the main fuel to increase ignition sensitivity thereof forming a pilot fuel further includes one of: a reformer; a catalytic device; or a partial oxidation combustor.

39. A diesel locomotive internal combustion engine comprising at least two cylinders, each having a reciprocating piston operatively connected to a crank and a combustion chamber, also comprising means for separately injecting a primary main fuel and a high combustion auxiliary pilot fuel into the combustion chambers of an internal combustion diesel engine comprising:

a processing system in fluid communication with the main fuel configured for receiving a portion of the main fuel and processing said portion of the main fuel to increase ignition sensitivity thereof and form the pilot fuel;

a main fuel system configured to introduce the main fuel into the combustion chamber; and a pilot fuel system to introduce the pilot fuel to control ignition of the main fuel in the diesel locomotive internal combustion engine.

* * * * *